United States Patent [19]

Jablin

[11] Patent Number: 4,960,499

[45] Date of Patent: Oct. 2, 1990

[54] COKE OVEN HOOD APPARATUS

[76] Inventor: Richard Jablin, 2500 W. Club Blvd., Durham, N.C. 27705

[21] Appl. No.: 388,054

[22] Filed: Aug. 1, 1989

[51] Int. Cl.[5] ..... C10B 27/00; C10B 33/14

[52] U.S. Cl. ..... 202/263; 201/27

[58] Field of Search ..... 202/263, 227; 201/41, 201/27

[56] References Cited

U.S. PATENT DOCUMENTS

| | | | |
|---|---|---|---|
| 3,647,636 | 3/1972 | Helm | 202/263 |
| 3,981,778 | 9/1976 | Schulte et al. | 202/263 |
| 4,100,033 | 7/1978 | Holter | 201/27 |
| 4,211,608 | 7/1980 | Kwasnoski et al. | 201/41 |
| 4,347,105 | 8/1982 | Kwasnik et al. | 202/263 |

FOREIGN PATENT DOCUMENTS

| | | | |
|---|---|---|---|
| 2131293 | 11/1972 | France | 202/263 |
| 1529611 | 10/1978 | United Kingdom | 202/263 |

*Primary Examiner*—Joye L. Woodard

*Attorney, Agent, or Firm*—Laubscher, Presta & Laubscher

[57] ABSTRACT

A pollution control system for capturing and incinerating the emissions to the atmosphere which arise when incandescent coke is pushed from a coke oven, includes a hood for capturing the emissions and a stack mounted on top of the hood for incinerating the emissions and in which a natural draft is produced for pulling the emissions into the hood. The hood is mounted on a railroad car which may be self-propelled or towed by a locomotive. The stack has a combustion system for producing heat therein, a damper for regulating the draft and a venturi section for mixing the particulates with the gasses. The mounting of the hood incorporates a power-operator for moving the hood into or away from contact with the coke guide of the coke ovens.

11 Claims, 3 Drawing Sheets

COKE OVEN HOOD APPARATUS

BACKGROUND OF INVENTION

This invention refers to the control of emissions to the atmosphere which result when hot coke is pushed from a coke oven. The amount and composition of these emissions vary depending on the physical condition of the coke oven and upon the manner in which it is operated. In a coke oven which is in good condition and in which coking temperatures and duration are proper, the emissions are relatively low in quantity and consist primarily of particulates of coke. When the condition of the oven is poor and/or operating conditions are inadequate, "green coke" is produced. In this case, the emissions consist of coke particles plus a variety of tars and hydrocarbons. The quantity of emissions in the former case may be about 0.25 kg per ton of coke produced; in the latter case it may be 1.0 kg per ton of coke produced.

A battery of coke ovens consists of a number of individual ovens, typically 35 to 70 in number, arranged side by side in a monolithic block of refractory brick. Coking times vary from 16 to 24 hours depending primarily on the condition of the ovens and the type of coke produced Coke is pushed from the ovens and coal charged into the ovens in a pre-determined schedule, the time between successive pushes being roughly equal to the coking time divided by the number of ovens in the battery.

Various pieces of machinery serve to operate a battery of coke ovens including a pusher to push the coke from the oven, a quench car to receive the hot coke and a coke guide to conduct the coke from the oven to the quench car. Each piece of machinery is movable along the length of the battery so that it may be positioned in alignment with the oven which is to be pushed. When the coke emerges from the coke guide it falls a distance into the quench car. The impact of the coke upon the body of the car causes most of the emissions. The ascent of the particles is aided by the rising current of gasses from the incandescent coke.

There are two methods of capturing the emissions which are in current use. Both methods employs a fixed, land-based dust collector. In one method, a duct running the length of the coke battery conducts the gasses from a movable collection hood to the dust collector. This method requires a means for connecting the hood to the duct at each of the numerous coke ovens of the battery. The other method has a large shed or building over the side of the battery that discharges coke, including the tracks for the quench car.

In either method, the dust collector is a large bag house, or a large wet electrostatic precipitator. The former requires the use of a precoat material in order to prevent the tarry products of the particles from sticking to the bags. The latter require an auxillary water treatment system to remove the particles from the water. Both require a large exhaust fan and a method for disposing of the dust which is collected.

Both methods of capturing the dust involve a large installation of equipment which is expensive to install and expensive the operate and maintain. The method using the duct has the additional disadvantage and complication of the multiplicities of connections between the hood and the duct. The shed has the additional disadvantage in that it worsens the atmosphere for the workers who are occupied in the space under it, and in that it accumulates tarry deposits on its inner surfaces.

In an effect to avoid some of the disadvantages of the two land-based methods, two methods using mobile dust collectors have been tried. One method involving a high efficiency steam jet was installed in a number of batteries, but was too complicated and difficult to operate, and was discarded. The other method uses water sprays in the hood in order to capture the dust. The efficiency of collection for this method was too low to meet environment standards, especially when "green coke" is produced. It also has the disadvantage of requiring a system to remove the dust from the spary water.

SUMMARY OF THE INVENTION

One object of this invention is to provide a system for collecting particles which arise from the pushing coke from a battery of coke ovens, which avoids all of the disadvantages of the previously mentioned existing methods. In the invention, the method used is to provide an incinerator, built in to the hood. There is, therefore, no need for a large dust collector, or the means for disposing of the collected dust.

Another object of this invention is to provide a mobile means of capturing and collecting the dust which is high in efficiency and which will meet environmental standards.

Another object of this invention is to provide suction for the collecting hood by means of natural draft in the stack from the incinerator, thereby avoiding the need for a large exhaust fan.

Another object of this invention is to provide a simple, uncomplicated system for capturing the dust which does not require an auxiliary system for cleaning contaminated water, or for disposing of the dust.

Other objects and a fuller understanding of the invention may be had by referring to the following description and claims, taken in conjunction with the accompanying drawings in which:

DESCRIPTION OF ILLUSTRATED EMBODIMENTS

Figure 1:
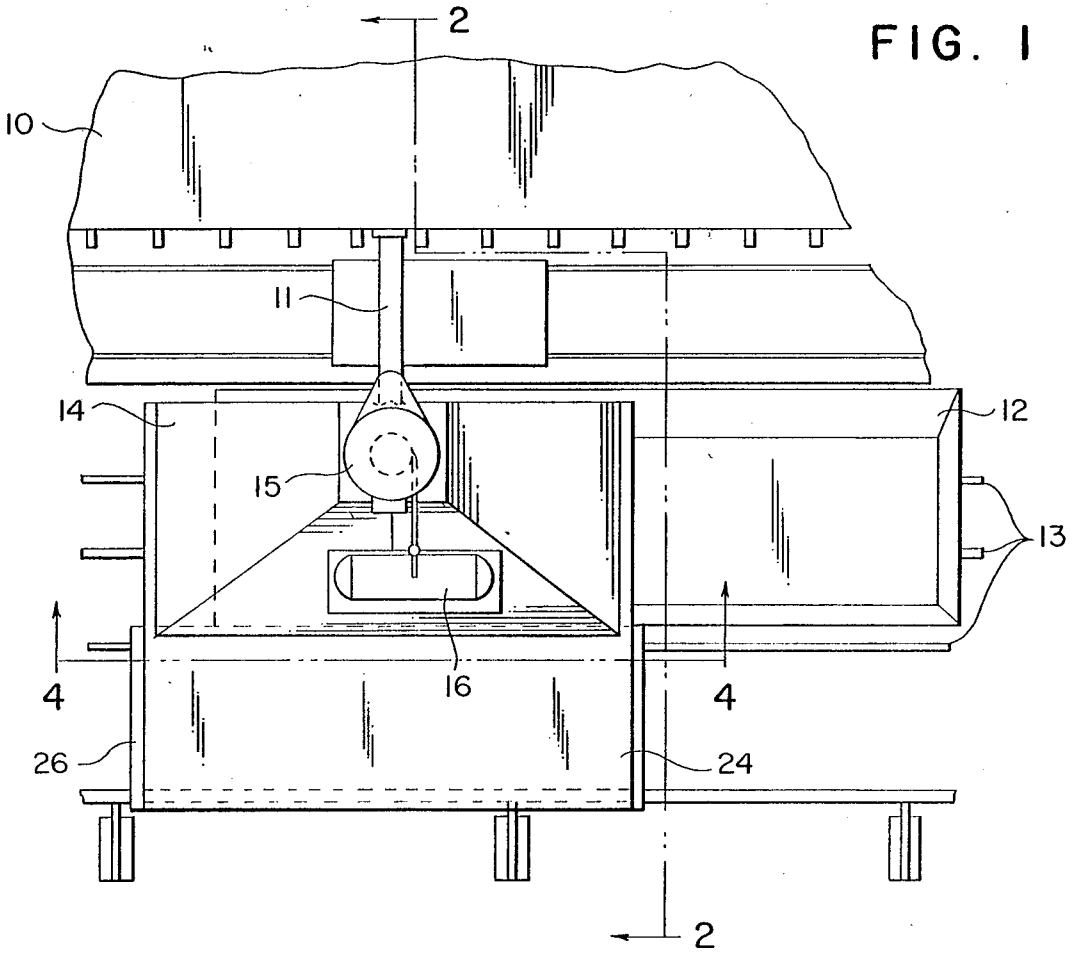
FIG. 1 is a plan view of the system for controlling emissions from the pushing of coke and which uses a separate hood and coke guide.
Figure 2:
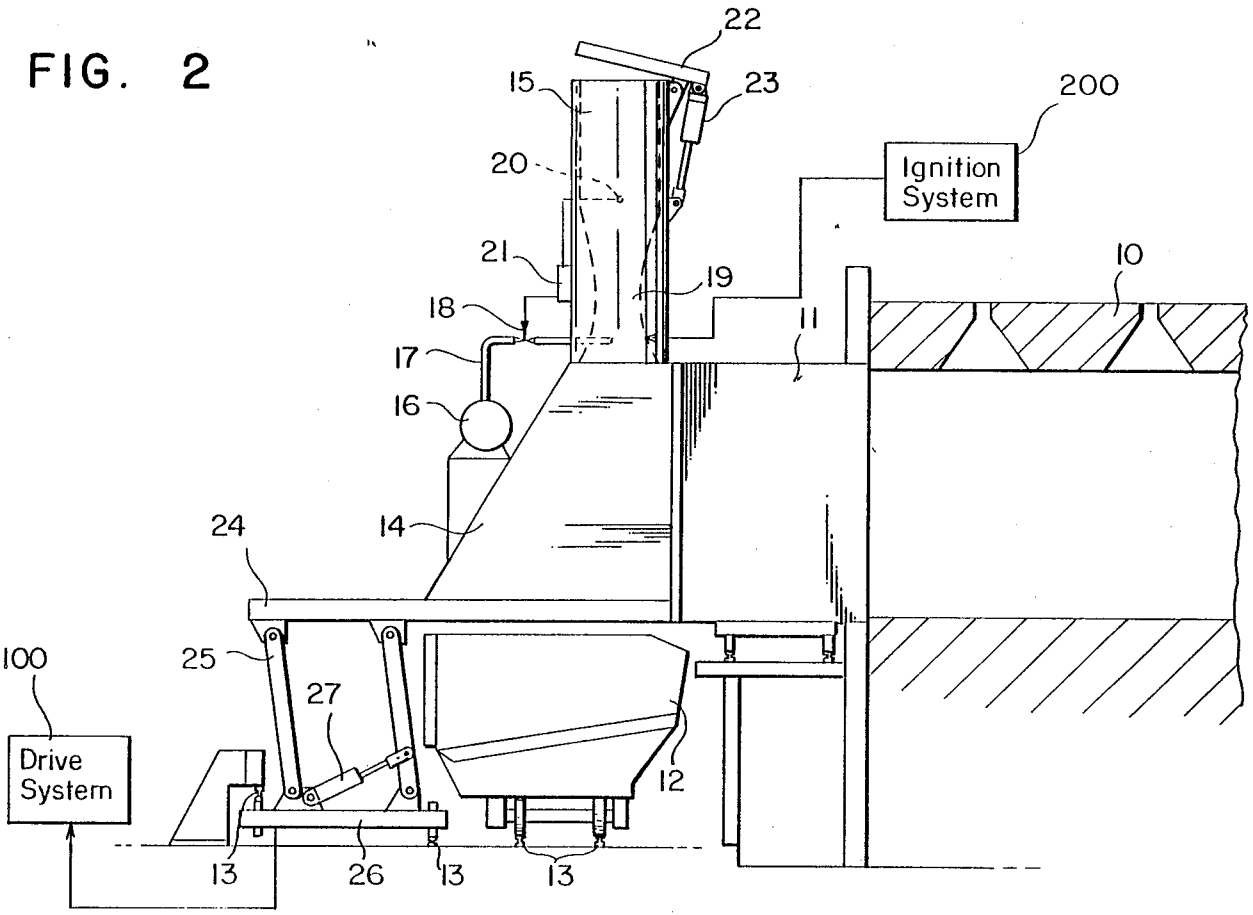
FIG. 2 is a vertical view taken on line 2—2 of FIG. 1.
Figure 4:
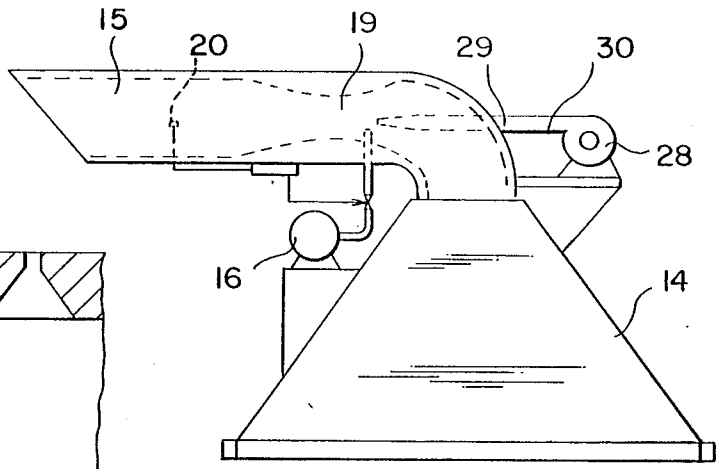
FIG. 4 is a vertical view of the hood taken on line 4—4 of FIG. 1 in which the stack is horizontal instead of vertical.

Referring now to the drawings, in which like reference numerals denote corresponding parts throughout the four views, the numeral 10 indicates the battery of coke ovens from which incandescent coke is successively pushed and during which pushing of coke, there are emissions to the atmosphere. During the push of coke, the coke travels through the coke guide 11 and falls into the quench car 12. When all of the coke is in the quench car, the car is towed by a locomotive, to a quenching station where the coke is cooled by deluging it with water. As shown, the quench car travels on railroad tracks 13.

The emissions which arise during the pushing of the coke are captured in the hood 14 and travel out to the atmosphere through the combustion stack 15. Fuel for providing heat to the stack is stored in storage tank 16 and is delivered to the stack through the pipe 17 and the control valve 18. The fuel and the emissions mix in the venturi section 19 of the combustion stack 15 and are ignited by an ignition means 200 such as a spark plug. Thermocouple 20, acting through the temperature control 21, regulates the control valve 18 and thereby, the amount of fuel delivered, so as to maintain a preset temperature within said stack.

The combustion stack 15 is fitted with a stack damper 22, the position of which is set by means of the damper power cylinder 23. The temperature within the stack is set so as to insure the incineration of the emissions which are primarily fine particles of coke that may or may not be coated with a very thin layer of tar, the pressure of the coating depending upon the operation of the battery 10. The prefered temperature setting to insure complete incineration of the emissions is approximately 1500° F., (815° C.). This elevated temperature creates a draft within the stack which pulls the emissions into the hood 14. The position of the damper 22 is set so as to avoid pulling excess air in at the bottom of the hood and so as to provide adequate time for the complete combustion and of the emissions.

The hood 14 is supported on support platform 24, which in turn, is supported by support arms 25, the arms being attached at the top to the platform and at the bottom to the hood car 26, both connections being pivoted. The hood car travels on railroad tracks 13 so that it may be positioned at any desired location along the battery 10. When the coke is to be pushed from an oven, the hood is placed in alignment with the coke guide 11 whereupon the hood power cylinders, acting through the support arms 25 force the hood into contact with the coke guide. When it is desired to move the hood car to another position along the battery, the hood power cylinders 27 move the hood clear of the coke guide.

The movement of the hood may be accomplished in one of two ways by a drive system 100. One way is to provided a traction drive for the hood car 26. The other way is to tow the hood 14 by means of a connection to the locomotive which tows the quench car 12. Both methods of propulsion are in common use and known to those skilled in the art and they are therefore not shown.

The purpose of having the combustion stack in the vertical configuration is, as stated above, to create the draft necessary to pull the emissions into the hood 14. In some situations, there are overhead obstructions which limit the height of the vertical stack and therefore limit the amount of draft obtainable. In such situations a horizontal configuration may be used for the combustion stack 15 and the necessary draft produced by means of the forced air blower 28 and air pipe 29 which provide a high velocity jet of induction air into the throat of the venturi section 19. The control damper 30 in the air pipe controls the strength of the high velocity jet and therefore the amount of draft which is produced in the stack. Thus, in this instance, the stack damper 22 is not needed. Also, the control damper 30 may be eliminated and control of the jet may be accomplished by providing the forced air blower 28 with a variable speed drive.

Figure 3:
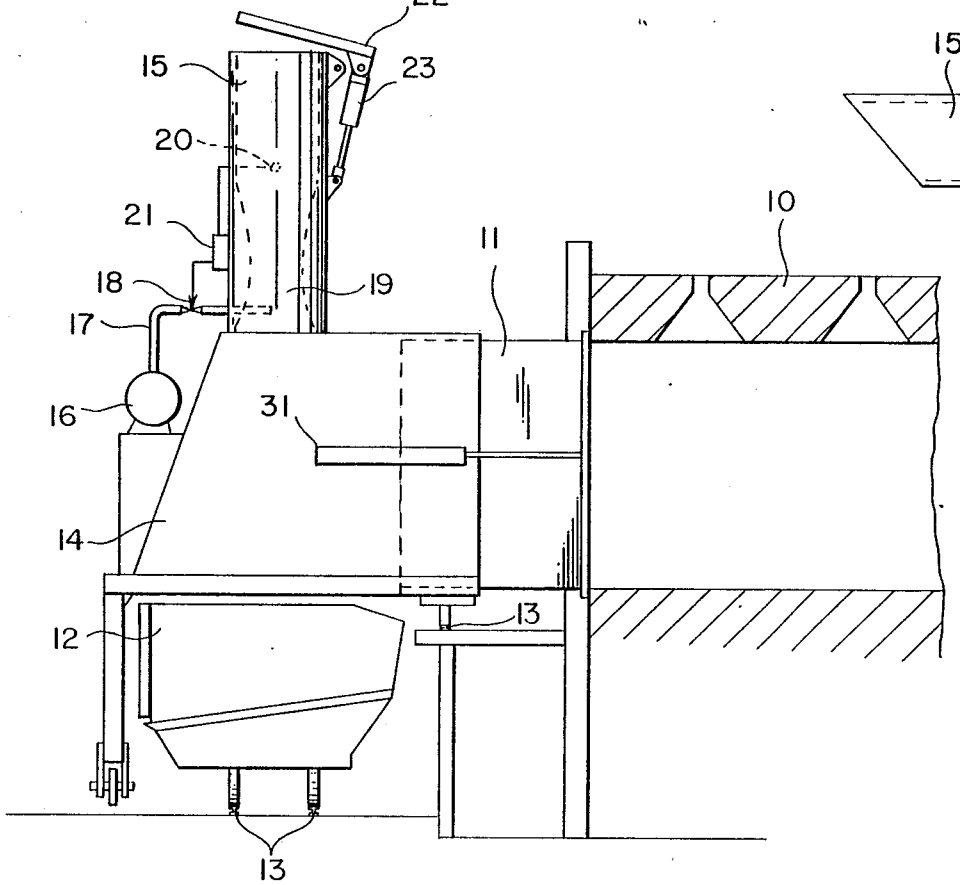
FIG. 3 is a vertical view, alternative to FIG. 2, in which the hood and coke guide are combined into one untit.

As an alternative to a separate hood 14 and coke guide 11, both units may be combined as shown in FIG. 3. Although this arrangement has the disadvantage that neither unit may move independently of the other, it has the advantage of requiring less space, being the more compact arrangement. In this case, when the coke guide 11 is in position to receive a coke push from an oven of the battery 10, guide power cylinders 31 force the coke guide into contact with the opening of the oven. When it is desired to move the hood 14 to another position along said battery, the guide power cylinders 31 move the coke guide clear of said oven.

It is understood to those skilled in the art, that the interior dimensions of the coke guide must be equal or greater than the interior dimensions of the ovens in respect to the cross section of both. This is necessary to permit free passage of the coke through the coke guide. For the same reason, an opening of adequate dimension must be provided in the side of the hood 14 where it contacts the side of the coke guide 11.

The purpose of the invention may be served by various alternatives to those described and illustrated. For examples, the fuel to the combustion stack 15 may be supplied directly from the battery of coke ovens 10, employing the use of gas, fuel hoses and quick disconnects for the hoses, thereby eliminating the need for the storage tank 16. Also, a variety of fuels may be used including liquid or gaseous fuels. These fuels may be stored in the storage tank under elevated pressure or under atmospheric pressure, in which latter case a fuel pump or compressor is required. In order to conserve the use of fuel, the supply of the fuel may be turned off whenever coke is not pushed from the ovens. To facilitate the combustion process when the fuel supply is turned on, the ignition of the fuel may be accomplished automatically as is in common practice in boilers and the like. Additionally, alternatives such as gear motor drives and the like may be used in place of the power cylinders.

Since many changes could be made in the above construction and many apparently widely different embodiments of this invention could be made without departing from the scope thereof, it is intended that all matter contained in the above description or shown in the accompanying drawings shall be interpreted as being illustrated only and not limiting.

I claim:

1. A pollution control system for coke ovens, comprising (a) a hood for capturing gaseous and particulate emissions arising during coke pushing into a quench car, said hook having side walls and being open at its upper and lower end;

(b) a vertically oriented combustion stack having a lower portion connected with the upper end of said hood for incinerating said emissions and for producing a draft which draws said emissions into said hood;

(c) a combustion system connected with said stack, including (1) a fuel storage tank;

(2) fuel admission means connected with said lower portion of said stack;

(3) automatic ignition means for igniting the fuel admitted to said stack; and (4) temperature control means for regulating the quantity of fuel admitted to said stack in order to maintain a desired temperature therein;

(d) an adjustable damper arranged in said stack for regulating the amount of air drawn into the open lower end of said hood by the natural draft produced in said stack; and (e) a movable hood car resting on railroad tracks extending parallel to a battery of coke ovens for supporting said hood, whereby said hood may be displaced along said battery of ovens to capture and ignite the emissions thereform.

2. Apparatus as defined in claim 1, where said stack lower portion contains an axially aligned venturi section for creating turbulence within said stack to insure thorough mixing of the emissions and fuel.

3. Apparatus as defined in claim 2, wherein said stack is lined with an insulating refractory material.

4. Apparatus as defined in claim 2, and further including means for moving said hood car along the tracks.

5. Apparatus as defined in claim 2, wherein said hood car includes support arms having opposing ends pivotally attached to said hood car and said hood, respectively, and power operated means for pivoting said support arms and moving said hood into and away from contact with a coke guide.

6. Apparatus as defined in claim 2, and further comprising a coke guide disposed within said hood and power operated means movably supporting said coke guide within said hood for moving said coke guide into and away from contact with a coke oven.

7. A pollution control system for coke ovens, comprising (a) a hood for capturing gaseous and particulate emissions arising during coke pushing into a quench car, said hood having side walls and being open at its upper and lower ends;

(b) a combustion stack having a first portion connected with the upper end of said hood for incinerating said emissions, and a second horizontal portion, said stack second portion containing an axially aligned venturi section;

(c) a combustion system connected with said stack, including (1) a fuel storage tank;

(2) fuel admission means connected with said first portion of said stack;

(3) automatic ignition means for igniting the fuel admitted to said stack; and (4) temperature control means for regulating the quantity of fuel admitted to said stack in order to maintain a desired temperature therein;

(d) a forced air blower having a delivery pipe arranged in said stack for supplying a high velocity jet of air axially into the throat of said venturi section toward the outlet end thereof to produce a draft within said stack;

(e) a control damper arranged within said delivery pipe for regulating the air flow of said jet, thereby to regulate the draft produced in said stack; and (f) a movable hood car resting on railroad tracks extending parallel to a battery of coke ovens for supporting said hood, whereby said hood may be displaced along said battery of ovens to capture and ignite the emissions therefrom.

8. Apparatus as defined in claim 7, wherein said stack is lined with an insulating refractory material.

9. Apparatus as defined in claim 7, and further including means for moving said hood car along the tracks.

10. Apparatus as defined in claim 7, wherein said hood car includes support arms having opposing ends pivotally attached to said hood car and said hood, respectively, and power operated means for pivoting said support arms and moving said hood into and away from contact with a coke guide.

11. Apparatus as defined in claim 7, and further comprising a coke guide disposed within said hood and power operated means movably supporting said coke guide within said hood for moving said coke guide into and away from contact with a coke oven.

* * * * *